US005447185A

United States Patent [19]

Koike

[11] Patent Number: 5,447,185

[45] Date of Patent: Sep. 5, 1995

[54] CHIP-REPLACEABLE NOSE BAR AND VENEER PEELING MACHINE USING THE SAME

[75] Inventor: Masaru Koike, Obu, Japan

[73] Assignee: Meinan Machinery Works, Inc., Obu, Japan

[21] Appl. No.: 234,526

[22] Filed: Apr. 28, 1994

[30] Foreign Application Priority Data

Apr. 30, 1993 [JP] Japan ..... 5-128195

[51] Int. Cl.[6] ..... B27L 5/02

[52] U.S. Cl. ..... 144/213; 144/209 R

[58] Field of Search ..... 144/209 R, 211, 212, 144/213, 214

[56] References Cited

U.S. PATENT DOCUMENTS

| | | | |
|---|---|---|---|
| 1,772,726 | 8/1930 | Menges | 144/212 |
| 2,607,377 | 8/1952 | Merritt | 144/212 |
| 3,055,406 | 9/1962 | Elford | 144/213 |
| 3,866,642 | 2/1975 | Walser | 144/212 |
| 4,061,169 | 12/1977 | Hasegawa | 144/213 |
| 4,269,243 | 5/1981 | Hasegawa | 144/213 |
| 4,494,589 | 1/1985 | Kajikawa et al. | 144/213 |
| 5,141,038 | 8/1992 | Nakaya | 144/213 |

*Primary Examiner*—W. Donald Bray
*Attorney, Agent, or Firm*—Pennie & Edmonds

[57] ABSTRACT

A nose bar is disclosed which is used in a veneer peeling machine which peels off a veneer with a cutting blade applied to a log for causing a chip to abut upon the peripheral surface of the log in the vicinity of the cutting blade, said nose bar comprising: a body portion, a retaining block detachably mounted on said body portion, and a replaceable chip fixedly retained by said body portion and said retaining block.

6 Claims, 7 Drawing Sheets

CHIP-REPLACEABLE NOSE BAR AND VENEER PEELING MACHINE USING THE SAME

BACKGROUND OF THE INVENTION

1. Field of the Invention

The present invention relates to a chip-replaceable nose bar used in a veneer peeling machine such as a veneer lathe and a veneer slicer, and to a veneer peeling machine comprising the nose bar.

2. Description of the Prior Art

The applicant of the .present application has previously proposed, in Japanese Utility Model Laid-open Publication No. 29204/1987, nose bars 9*a* each of which comprises a holder 13*a* mounted on a veneer peeling machine body (not shown) and having its tip portion formed with a groove 29*a* running,from one side to the other side in the direction parallel with a cutting blade (not shown); and a replaceable chip 15A including a pressure applying portion 15*a* which abuts upon the peripheral surface of a log, and a mounting portion 15*b* having its cross-sectional contour in the direction perpendicular to the cutting edge of the veneer cutting blade substantially conformed to the cross-sectional contour of the groove 29*a* in the same direction, the mounting portion 15*b* being fitted into the groove 29*a*, as shown in FIG. 7A to 7E in the present application.

However, the above nose bars have a problem in that since the chip-attached tip portion of the holder of such a nose bar, which is located at the lower position in terms of the rotational direction of the log, is vibrated during veneer peeling to undergo abrasion or is likely to be corroded with rust, there is undesired possibility of dislocation of the chip from the predetermined position relative to the cutting blade to prevent the peripheral surface of the log from being uniformly pressed or undesired possibility of the chip coming off, thereby preventing high quality veneer peeling.

Although this drawback can be solved by replacing the holder per se when tip portion of the holder is abraded or rusted, another problem is caused in that maintenance cost is high because of expensiveness of the holder per se.

Although the above drawback can be solved by forming the holder from a highly abrasion resistant material such as a stainless steel, still another problem is caused in that when the log strikes against the holder due to operational error during cutting of the log and, as a result, excessive force is exerted on the holder, the holder undergoes plastic deformation because of a narrow elastic region of the holder made of a stainless steel to cause dislocation of the chip from its predetermined position relative to the cutting blade, thereby preventing a veneer with high quality from being peeled off.

SUMMARY OF THE INVENTION

It is an object of the present invention to provide a nose bar capable of solving the above disadvantages and of constantly peeling off a veneer with high quality. More specifically, it is an object of the present invention to provide a nose bar capable of being economically repaired at a low cost even if the chip undergoes dislocation from its predetermined position relative to the cutting blade, which causes precisional deterioration in veneer peeling, due to abrasion of the chip or the tip portion of the nose bar or the like, thereby enabling high quality veneer peeling.

It is another object of the present invention to provide a nose bar capable of preventing the holder body from accidentally undergoing plastic deformation as well as capable of always maintaining the predetermined position of the chip relative to the cutting blade with high accuracy, thereby enabling high quality veneer peeling.

It is a further object of the present invention to provide a veneer peeling machine comprising a nose bar having the above-mentioned structure, which is capable of continuously preparing a veneer with high quality.

The present invention has been made to overcome the above-mentioned drawbacks inherent in conventional nose bars, and there is disclosed, as a basic embodiment thereof, a nose bar used in a veneer peeling machine which peels off a veneer with a cutting blade applied to a log for causing a chip to abut upon the peripheral surface of the log in the vicinity of the cutting blade, said nose bar comprising:

- a holder body as a body portion,
- a retaining block detachably mounted on said body portion, and
- a replaceable chip retained by said body portion and said retaining block.

According to a preferred embodiment of the present invention, the nose bar comprises:

- a holder body formed with a retaining indentation in its side facing the peripheral surface of said log and at its end portion proximal relative to said cutting blade;
- a replaceable chip fitted into said retaining indentation with its portion projecting from said side facing the peripheral surface of the log toward the log, and
- a chip retaining block which is detachably mounted on the end surface of said holder body proximal relative to said cutting blade and which is pressed against the chip fitted in said retaining indentation, when mounted, to enable said chip to be fixed to the holder body with the chip held between the retaining block and the holder body.

In the present invention, there is no particular restriction with respect to the materials of the holder body and the retaining block so long as each of them has requisite stiffness. However, it is effective for attaining the intended objects to use a holder body made of a spring steel and a chip retaining block made of a stainless steel.

According to the present invention, a veneer peeling machine comprising the above-mentioned nose bar is also disclosed.

According to the above-described structure of the present invention, when the chip is abraded or damaged, the chip is replaced by releasing the chip from the retained condition by the action of the retaining block, then removing the abraded or damaged chip, applying a new chip to the retaining indentation, and tightening the block to retentively hold the new chip.

When a tip portion of the nose bar is impaired with rust or the like, the nose bar can be kept operative as such by replacing only the retaining block without replacing the holder body.

DETAILED DESCRIPTION OF THE PREFERRED EMBODIMENT

Now, an embodiment of the present invention will be described with reference to the drawings.

Figure 1:
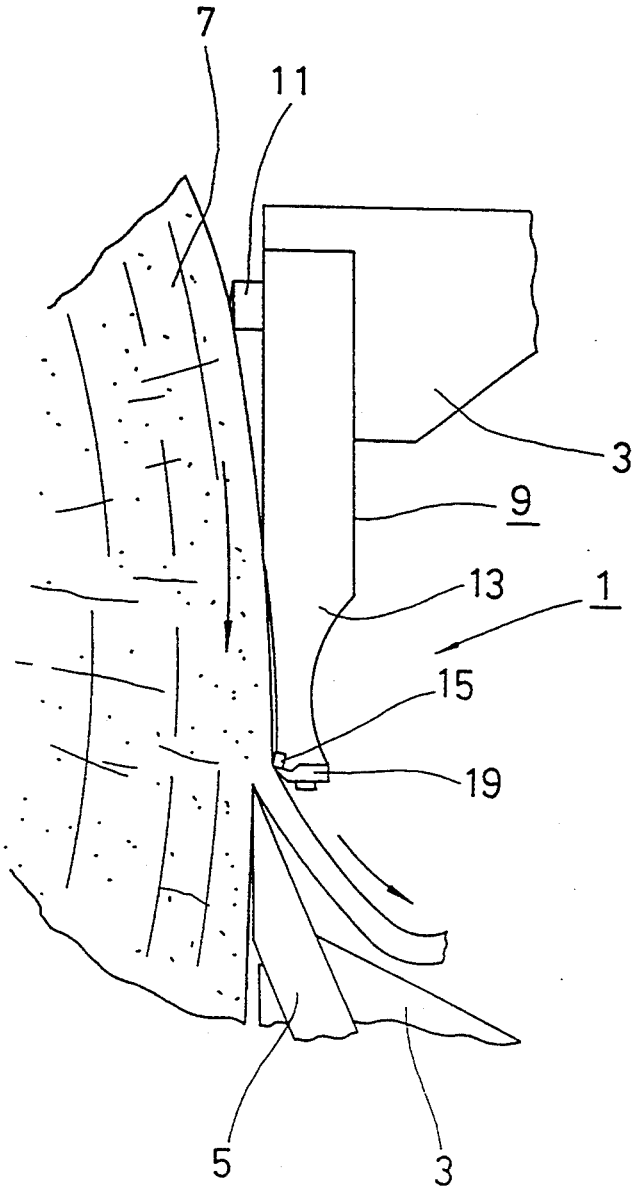
FIG. 1 is a side view showing installation condition of the nose bar in a veneer peeling machine.

A cutting blade 5 is mounted on a blade stock 3 of a veneer lathe 1 as a veneer peeling machine in such a manner that its cutting edge protrudes from the blade stock 3 and extends substantially in parallel with an axis of spindles (not shown) which chuck a log 7 and cause the log 7 to rotate in the clockwise direction shown in FIG. 1 by the arrow. To the upper portion of the blade stock 3, a plurality of nose bars 9 are fixed by screws 11 in parallel with the axis of the spindles at regular intervals in such a manner that a tip portion of each of the nose bars 9 is located proximally relative to the cutting blade 5 so as to tangentially abut against the peripheral surface of the log 7 in the vicinity of the cutting edge of the cutting blade 5. In each of the intervals between the neighboring nose bars 9, a driving roll (not shown) is disposed which bite-engages with the peripheral surface of the log 7 to causes the log 7 to rotate in the direction shown in FIG. 1 by the solid arrow.

Figure 2:
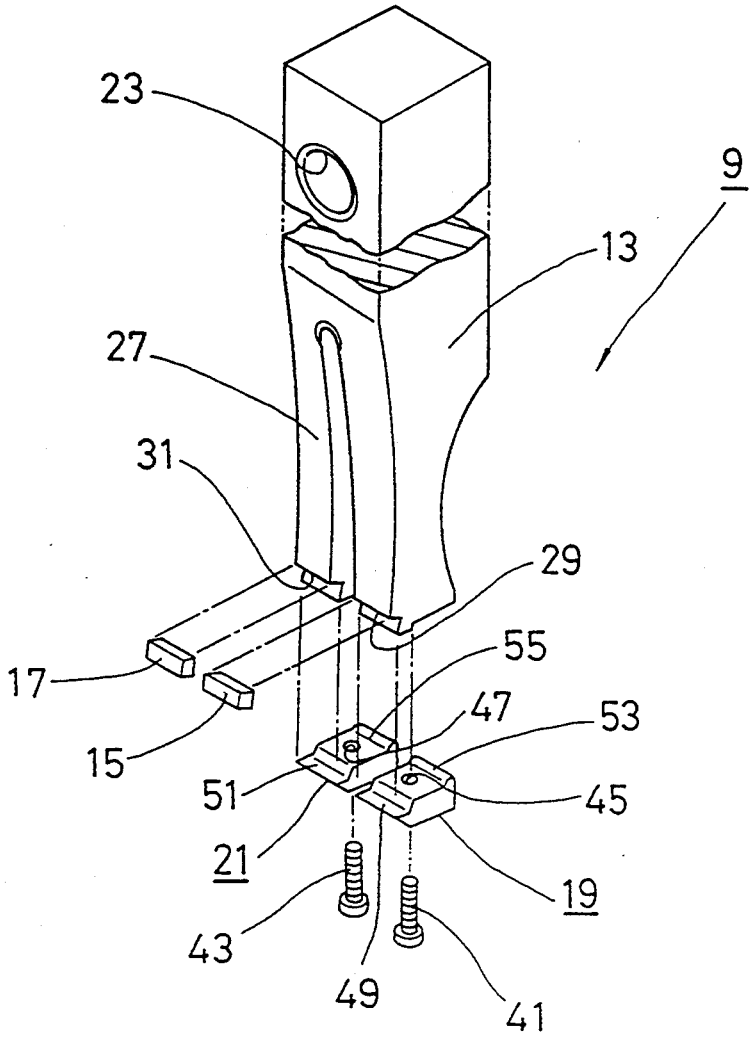
FIG. 2 is a perspective exploded view of the nose bar.
Figure 3:
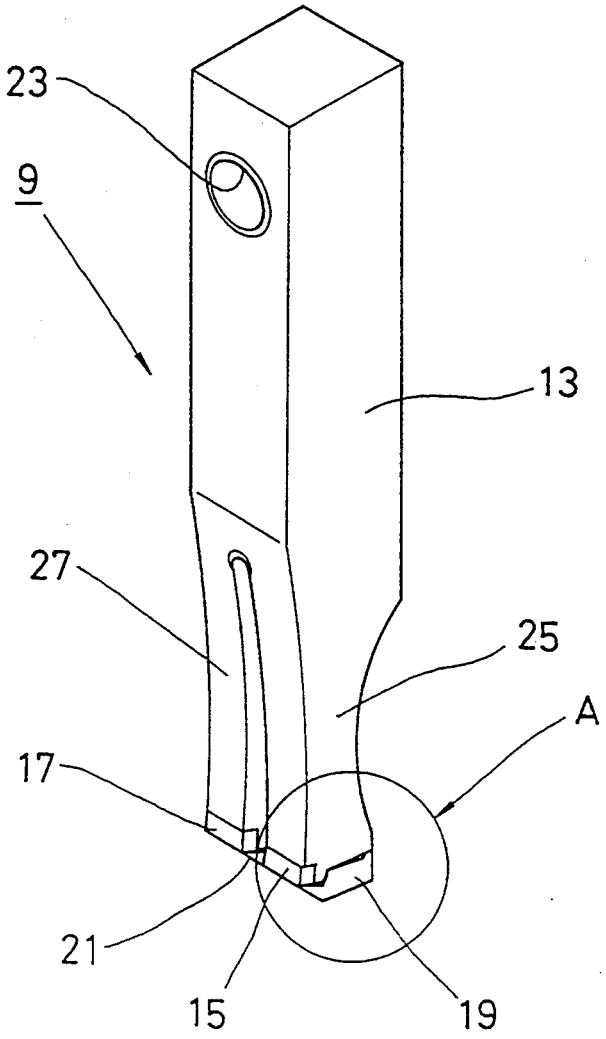
FIG. 3 is a perspective general view of the nose bar.

Each of the nose bars 9 comprises a holder body 13, chips 15 and 17, and retaining blocks 19 and 21 for respectively fixing the chips 15 and 17 to the holder body 13, as shown in FIGS. 2 and 3. The holder body 13 is made of a spring steel , which has a wide elastic region. A through hole 23, into which the screw 11 is inserted as shown in FIG. 1, is formed in the base portion (distal position relative to the cutting blade) of the holder body 13 which is located at the upper position in terms of the rotational direction of the log 7. At the tip portion of the holder body 13 which is located proximally relative to the cutting blade, bifurcations 25 and 27 are integrally formed which extend in parallel with each other at a predetermined distance toward the cutting blade.

Figure 4:
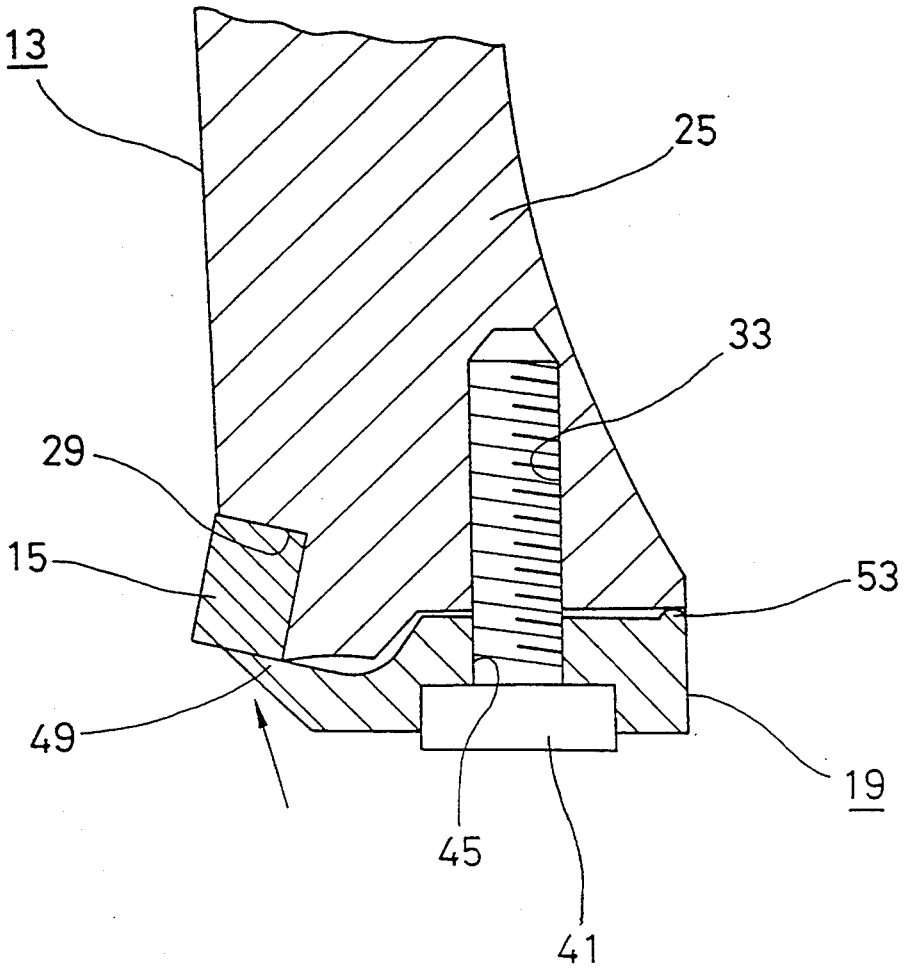
FIG. 4 is an enlarged cross-sectional view of the encircled A-portion in FIG. 3.

Retaining indentations 29 and 31 are formed in the fronts, which face to the log 7, of the tip portions of the bifurcations 25 and 27, respectively. In each of the tip ends (end faces proximal relative to the cutting blade) of the bifurcations 25 and 27 is formed a threaded hole 33, as shown in FIG. 4 (the threaded hole in the other bifurcation 27 is not shown). Chips 15 and 17 having a substantially rectangular cross-section in the direction perpendicular to the axis of the spindles applied into the retaining indentations 29 and 31, respectively, in such a manner that the lower front edges of the chips 15 and 17 slightly protrude from the front surfaces of the bifurcations 25 and 27 respectively, which face to the log 7, toward the log 7. Each of the chips 15 and 17 is made of a material having high abrasion resistance such as a super hard alloy, a cermet or a ceramic. Retaining blocks 19 and 21 are adapted to be fixed to the tip surfaces of the bifurcations 25 and 27 by screws 41 and 43 with the chips 15 and 17 applied into the retaining indentations 29 and 31, respectively. Each of the retaining blocks 19 and 21 is made of a metallic material, and at the position corresponding to the threaded holes 33 in the retaining blocks 19 and 21 are formed holes 45 and 47 for inserting the screws 41 and 43 through the retaining blocks 19 and 21 into the threaded holes 33. The retaining blocks 19 and 21 are formed with pressure exerting portions 49 and 51 at their side located facing to the retaining indentations 29 and 31, which are so configured as to abut upon the surfaces proximal to the cutting blade (the lower surfaces in FIG. 4) of the chips 15 and 17 applied into the retaining indentations 29 and 31, respectively, as shown in FIG. 4.

At the sides opposite to the pressure exerting portions 49 and 51 and on the surfaces facing the tip ends of the bifurcations 25 and 27 (the upper surfaces in FIG. 4)-of the retaining blocks 19 and 21, projections 53 and 55 are integrally formed, respectively. When the retaining blocks 19 and 21 are attached to the tip ends of the bifurcations 25 and 27, by the presence of the projections 53 and 55, there are formed very narrow gaps between the tip ends of the bifurcations 25 and 27 and the upper surfaces of the retaining blocks 19 and 21 with the pressure exerting portions 49 and 51 pressed against the lower surfaces of the 15 and 17, respectively, as shown in FIG. 4.

In the next place, a manner for attaching the chip to the holder body and for replacing the same will be described.

First, the screws 41 and.43 are incompletely screwed into the threaded holes 33 through the holes 45 and 47 of the retaining blocks 19 and 21, respectively. Then, the chips 15 and 17 are inserted into the notch-like grooves defined by the retaining indentations 29 and 31 and the retaining blocks 19 and 21, respectively, and the screws 41 and 43 are tightened to retain the chips 15 and 17, respectively.

In this connection, very narrow gaps are formed between the tip surfaces of the bifurcations 25 and 27 and the retaining blocks 19 and 21 by the presence of the projections 53 and 55, respectively. Consequently, as the retaining blocks 19 and 21 are screwed onto the bifurcations 25 and 27, the retaining blocks 19 and 21 are caused to pivot on the projections 53 and 55 in the direction shown in FIG. 4 by solid arrow to bias the chips 15 and 17, thereby enabling the chips 15 and 17 to be tightly held and fixed to the bifurcations 25 and 27, respectively.

Then, the nose bars 9 to which the chips 15 and 17 have been fixed as described above are mounted on the blade stock 3, and a veneer is peeled off with the chips 15 and 17 caused to abut upon the peripheral surface of the log 7, which are rotating in the direction shown in FIG. 1 by the solid arrow, in the vicinity of the cutting edge of the cutting blade 5 applied to the peripheral surface of the log 7.

When the chip 15 or 17 is damaged or abraded due to the above-described veneer peeling, the chip 15 or 17 is replaced as follows. The screw 41 or 43 is loosened to release the chip 15 or 17 from the the retained condition by the action of the retaining block 19 or 21, and then the damaged or abraded chip 15 or 17 is removed from the retaining indentation 29 or 31, respectively. Thereafter, a new chip 15 or 17 is applied into the retaining indentation 29 or 31, and then the screw 41 or 43 is screwed to retain the chip 15 or 17 by the retaining block 19 or 21, respectively.

According to this embodiment, when a chip 15 or 17 is damaged or abraded, the chip 15 or 17 is extremely readily replaced by loosening the screw 41 or 43to release the chip 15 or 17 from the retaining condition by the action of the retaining block 19 or 21. If the retaining block 19 or 21 is impaired with rust, the nose bar 9 is kept operative as such by replacing only the retaining block 19 or 21 which is small and inexpensive as compared with the holder body 13. Accordingly, maintenance cost is extremely reduced as compared with the case where a holder body per se is conventionally replaced.

In the above embodiment, a plurality of nose bars 9 having a holder body whose portion proximal relative to the cutting blade is bifurcated are arranged on the blade stock 3 in parallel with the axis of the spindles at regular intervals. According to the present invention, however, a holder body whose portion proximal relative to the cutting blade is not bifurcated, i.e., an unfurcated holder body may be used, and further, a single nose bar having substantially the same length, in the direction of the axis of the spindles as that of the log to be cut may be used. In this embodiment, there is no particular restriction with respect to the material for the retaining blocks 19 and 21. However, when the retaining blocks 19 and 21 are made of a stainless steel, problems such as corrosion damage due to rust can be solved.

Figure 5:
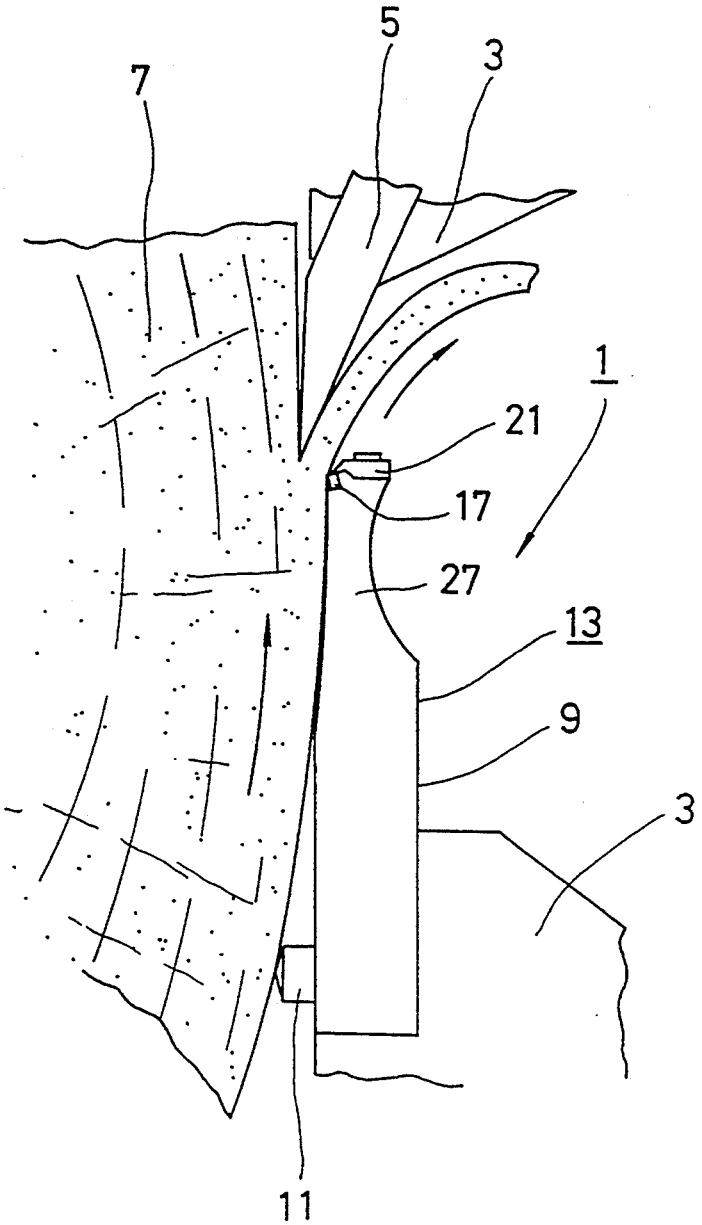
FIG. 5 is a side view of an alternative embodiment of the present invention.
Figures 6A, 6B, 6C, 6D, 6E:
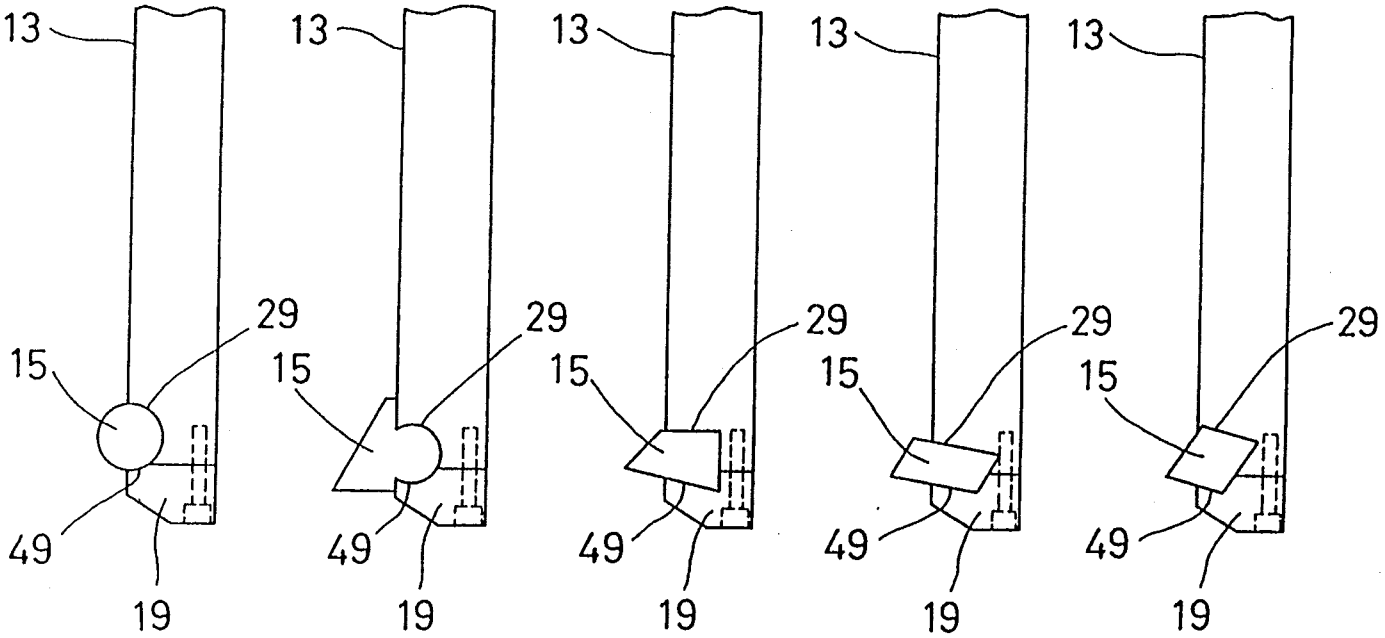
FIGS. 6A–6E show diagrammatic views of other embodiments of the nose bar of the present invention.
Figures 7A, 7B, 7C, 7D, 7E:
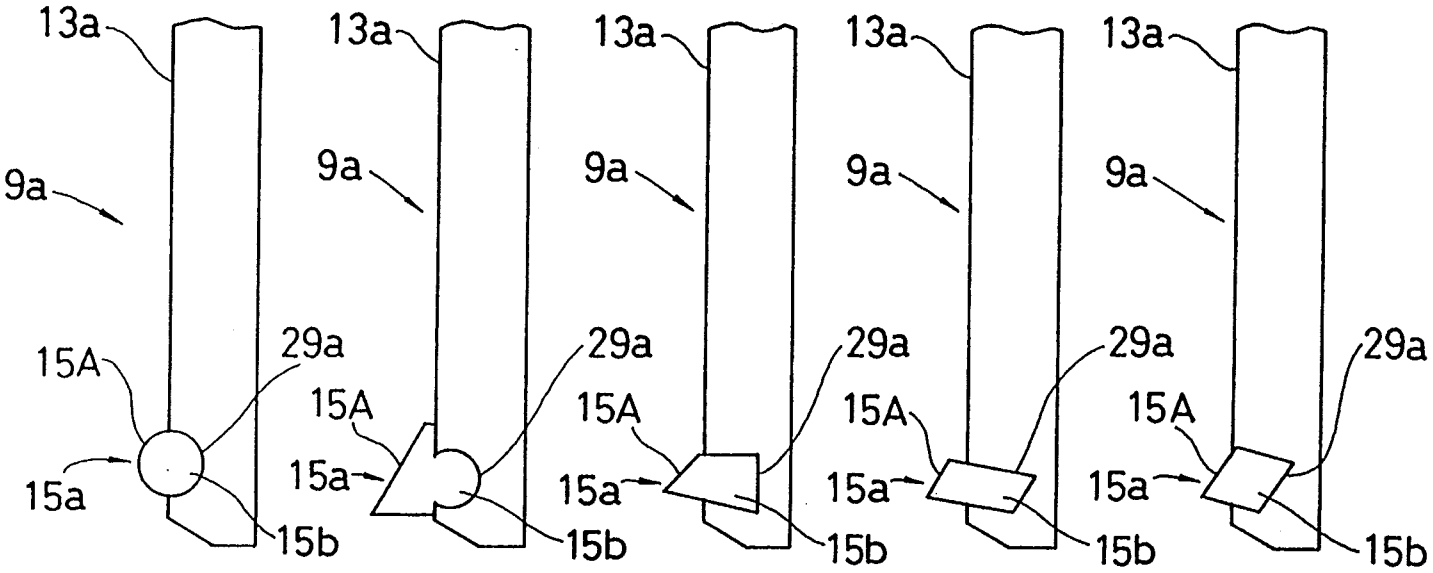
FIG. 7A–7E diagrammatically show conventional nose bars.

In the above description, a veneer lathe as a veneer peeling machine is described with reference to the drawings. However, the veneer peeling machine may be a veneer slicer which slices off a veneer from a log (flitch). Further, when a veneer lathe is used as a veneer cutting machine, it may have such a structure that a cutting blade 5 and nose bars 9 are attached to a blade stock 3 at positions reverse to those in this embodiment, as shown in FIG. 5. In other words, the cutting blade is located below the nose bars in this embodiment as shown in FIG. 1, whereas the cutting blade is located above the nose bars in the embodiment shown in FIG. 5.

Further, each of the chips 15 and 17 used in the above-described embodiment has a substantially rectangular cross-section. However, the chip to be retained in the holder body 13 according to the present invention may have any configuration. As previously disclosed in the above-mentioned Japanese Utility Model Laid-open Publication No. 29204/1987, the chip may have a circular or polygonal cross-section, or a cross-section of a combination of circular and polygonal shapes, as shown in FIG. 7A to 7E. In this connection, the shape of the retaining indentation 29 formed in the holder body 13 and the shape of the pressure exerting portion 49 of the retaining block 19 are appropriately selected in conformity with the cross-sectional contour of the chip 15 to fixedly retain the chip 15, as shown in FIGS. 6A to 6E.

As described above, according to the present invention, the chip can extremely readily be replaced.

If the tip portion of the nose bar which is located proximally relative to the cutting blade is impaired with rust, the nose bar can be repaired, without replacing the holder body, by replacing only the retaining block which is inexpensive as compared with the holder body. Accordingly, maintenance cost can be reduced.

What is claimed is:

1. A nose bar used in a veneer peeling machine which peels off a veneer with a cutting blade applied to a log for causing a chip to abut upon the peripheral surface of the log in the vicinity of the cutting blade, said nose bar including:

a body portion a retaining block detachably mounted on the body portion at the downstream side end of the body portion in the direction of movement of the veneer, and a replaceable chip non-rotatably retained by said body portion and said retaining block.

2. A nose bar in a veneer peeling machine which peels off a veneer with a cutting blade applied to a log for causing a chip to abut upon the peripheral surface of the log in the vicinity of the cutting blade, said nose bar including:

a holder body formed with a retaining indentation in its side facing the peripheral surface of said log and at its end portion proximal relative to said cutting blade;

a replaceable chip fitted into said retaining indentation with its portion projecting from said side facing the peripheral surface of the log toward the log, and a chip retaining block which is detachably mounted on the end surface of said holder body at the downstream side end of the holder body in the direction of movement of the veneer and is pressed against the chip fitted in said retaining indentation, when mounted, to enable said chip to be fixed to the holder body with the chip held between the retaining block and the holder body.

3. The nose bar according to claim 1 or 2, wherein said holder body is made of a spring steel, which has awide elastic region, and said chip retaining block is made of a stainless steel.

4. A veneer peeling machine including the nose bar according to claim 1 or 2.

5. A veneer lathe including the nose bar according to claim 1 or 2.

6. A veneer slicer including the nose bar according to claim 1 or 2.

* * * * *